US010037047B2

(12) United States Patent
Quelen

(10) Patent No.: US 10,037,047 B2
(45) Date of Patent: Jul. 31, 2018

(54) REFERENCE VOLTAGE GENERATION CIRCUIT

(71) Applicant: Commissariat à l'Énergie Atomique et aux Énergies Alternatives, Paris (FR)

(72) Inventor: Anthony Quelen, Seyssins (FR)

(73) Assignee: Commissariat à l'Énergie Atomique et aux Énergies Alternatives, Paris (FR)

( * ) Notice: Subject to any disclaimer, the term of this patent is extended or adjusted under 35 U.S.C. 154(b) by 0 days.

(21) Appl. No.: 15/365,039

(22) Filed: Nov. 30, 2016

(65) Prior Publication Data

US 2017/0153659 A1 Jun. 1, 2017

(51) Int. Cl.
*G05F 3/26* (2006.01)

(52) U.S. Cl.
CPC ..... *G05F 3/267* (2013.01)

(58) Field of Classification Search
None
See application file for complete search history.

(56) References Cited

U.S. PATENT DOCUMENTS 7,633,334 B1 * 12/2009 Li ..... G05F 3/30 323/313
9,519,304 B1 * 12/2016 Far ..... G05F 3/262
2004/0239413 A1 * 12/2004 Gubbins ..... H03K 17/145 327/539
2011/0121809 A1 5/2011 Camacho Galeano et al.
2012/0218026 A1 * 8/2012 Nadimpalli ..... G05F 3/242 327/513
2012/0242398 A1 9/2012 Olmos et al.
2012/0323508 A1 12/2012 Vilas Boas et al.
2014/0077864 A1 * 3/2014 Bianchi ..... G01K 7/01 327/512

OTHER PUBLICATIONS

Ueno et al., A 300nw, 15ppm/C, 20ppm/V CMOS Voltage Reference Circuit Consisting of Subthreshold MOSFETs., Jul. 7, 2009, pp. 2047-2054.*
French Search Report, dated Aug. 19, 2016, from a corresponding or related French Application No. 15/61551.
Ueno et al.: "A 300 nW, 15 ppm/C, 20 ppm/V CMOS Voltage Reference Circuit Consisting of Subthreshold MOSFETs," (2009) IEEE Journal of Solid-State Circuits; pp. 2047-2054.
(Continued)

*Primary Examiner* — Jeffrey Gblende
(74) *Attorney, Agent, or Firm* — Wolf, Greenfield & Sacks, P.C.

(57) ABSTRACT

An FDSOI reference voltage generation circuit, including a CTAT current generation circuit; a PTAT-type voltage generation circuit including a first branch including first and second series-connected transistors, the front surface gates of the first and second transistors being connected to the conduction node of the second transistor opposite to the first transistor; a third diode-assembled transistor having a conduction node connected to an output node of the PTAT voltage generation circuit and having its other conduction node forming a reference voltage supply node; and a current mirror; wherein the first and second transistors are of LVT type and the third transistor is of RVT type.

15 Claims, 2 Drawing Sheets

(56) References Cited

OTHER PUBLICATIONS

Mazurier et al.: "On the Variability in Planar FDSOI Technology: From MOSFETs to SRAM Cells," (2011) IEEE Transactions on Electron Devices; pp. 2326-2336.
Makippa et al.: "FDS0I versus BULK CMOS at 28 nm node which technology for ultra-low power design?" (2013); pp. 554-557.
Arnaud: "Enhanced low voltage digital & analog mixed-singal with 28nm FDS01 technology," (2015) IEEE S01-3D-Subthreshold Microelectronics Technology Unified Conference; pp. 1-4.
De Vita & Iannaccone: "A Sub-1-V, 10 ppm/° C., Nanopower Voltage Reference Generator," (2007) IEEE Journal of Solid-State Circuits; pp. 1537-1542.
Samir et al.: "173nA-7.5ppm/° C.-771mV-0.03mm$^2$ CMOS Resistorless Voltage Reference," (2011) Faible Tension Faible Consommation (FTFC); pp. 71-74.
Qin: A 280nA, 87ppm/° C., High PSRR Full CMOS Voltage Reference and Its Application, (2012) IEEE; pp. 155-158.
Anvesh A & Baghini: "A Sub-1V 32nA Process, Voltage and Temperature Invariant Voltage Reference Circuit," (2013) IEEE; pp. 136-141.
Osaki et al.: "1.2 V Supply, 100-nW, 1.09-V Bandgap and 0.7-V Supply, 52.5-nW, 0.55-V Subbandgap Reference Circuits for Nanowatt CMOS LSIs," (2013) IEEE Journal of Solid-State Circuits; pp. 1530-1538.

* cited by examiner

REFERENCE VOLTAGE GENERATION CIRCUIT

CROSS-REFERENCE TO RELATED APPLICATION

This application claims the priority benefit of French patent application number 15/61551, filed Nov. 30, 2015, which is hereby incorporated by reference in its entirety to the maximum extent allowable by law.

BACKGROUND

The present disclosure generally relates to the field of electronic systems, and more particularly aims at a reference voltage generation circuit.

DISCUSSION OF THE RELATED ART

Many electronic systems use a reference voltage generation circuit to generate, from a DC power supply voltage of the system, a DC reference voltage independent from fluctuations of the power supply voltage and independent from temperature variations. Such a circuit is generally integrated in a semiconductor chip, which may be an autonomous chip or which may comprise other circuits intended to implement other functions of the system.

Reference voltage generation circuits formed from bipolar transistors have already been provided. A disadvantage of such circuits is that, to obtain a good temperature stability, the reference voltage should be relatively high, typically in the order of 1.2 V.

In certain electronic systems, particularly in low power supply voltage systems (for example, systems intended to be powered under a voltage in the range from 1.2 V to 4 V), it is desired to have a lower reference voltage, typically smaller than 1 V, for example, a voltage in the order of 0.9 V. Circuits for generating a reference voltage smaller than 1 V formed based on MOS transistors have been provided. Examples of such circuits are in particular described in the following publications: [1] "A 300 nW, 15 ppm/C, 20 ppm/V CMOS Voltage Reference Circuit Consisting of Subthreshold MOSFETs", Ken Ueno, IEEE JOURNAL OF SOLID-STATE CIRCUITS, VOL. 44, No. 7, July 2009; [2] "173 nA-7.5 ppm/C-771 mV-0.03 mm2 CMOS Resistorless Voltage Reference", A. Samir, 2011 Faible Tension Faible Consommation (FTFC); [3] "A 280 NA, 87 PPM/oC, HIGH PSRR FULL CMOS VOLTAGE REFERENCE AND ITS APPLICATION", Song QIN, 978-1-4673-1717-7112/$31.00 ©2012 IEEE; [4] "A Sub-1-V, 10 ppm/C, Nanopower Voltage Reference generator", Giuseppe De Vita, IEEE JOURNAL OF SOLID-STATE CIRCUITS, VOL. 42, No. 7, July 2007; [5] "A Sub-1V 32 nA Process, Voltage and Temperature Invariant Voltage Reference Circuit", Anvesha A, 2013 26th International Conference on VLSI Design; and [6] "1.2-V Supply, 100-nW, 1.09-V Bandgap and 0.7-V Supply, 52.5-nW, 0.55-V Subbandgap Reference Circuits for Nanowatt CMOS LSIs", Yuji Osaki, IEEE JOURNAL OF SOLID-STATE CIRCUITS, VOL. 48, No. 6, June 2013.

Such circuits however have various disadvantages. In particular, such circuits are relatively sensitive to manufacturing process variations, and accordingly have a relatively low intrinsic accuracy. In other words, two different circuits formed according to the same process may, due to process dispersions, generate different reference voltages. In the circuit described in above-mentioned article [1], the variability of the reference voltage according to manufacturing process variations is actually searched for and used to characterize and compensate for process dispersions.

The forming of a reference voltage generation circuit based on MOS transistors is here more particularly considered, this circuit having a better intrinsic accuracy than known circuits, that is, supplying a reference voltage which is less dependent on method dispersions than in known circuits.

It should be noted that to guarantee that different chips do supply the same reference voltage, post-manufacturing adjustment steps may be provided. However, such steps, as well as the possible provision of adjustment components on the chips, generate an excess cost which is all the greater as the intrinsic accuracy of the circuit is low.

It would be desirable to have a circuit for generating a reference voltage overcoming all or part of the disadvantages of known circuits, and in particular having a better intrinsic accuracy than known circuits.

SUMMARY

Thus, an embodiment provides a circuit for generating a reference voltage formed in FDSOI technology, comprising: a first circuit for generating a CTAT-type bias current; a second circuit for generating a PTAT-type voltage comprising a first branch comprising first and second series-connected transistors, the front surface gates of the first and second transistors being connected to the conduction node of the second transistor opposite to the first transistor; a third diode-assembled transistor having a conduction node connected to a node for supplying the output voltage of the second circuit and having its other conduction node forming a node for supplying the reference voltage; and a current mirror imposing, in the third transistor on the one hand, and in the first branch, on the other hand, currents proportional to the bias current, wherein the first and second transistors are of LVT type and the third transistor is of RVT type.

According to an embodiment, the first transistor has a first front surface gate oxide thickness and the second and third transistors have a second front surface gate oxide thickness greater than the first thickness.

According to an embodiment, the first, second and third transistors are NMOS transistors, the drain of the first transistor being connected to the source of the second transistor, the drain of the second transistor being connected to the gates of the first and second transistors, and the source of the third transistor being connected to a node for supplying the output voltage of the second circuit.

According to an embodiment, the second circuit further comprises a second branch comprising fourth and fifth series-connected transistors, the front surface gates of the fourth and fifth transistors being connected to the conduction node of the fifth transistor opposite to the fourth transistor, and the conduction node of the fourth transistor opposite to the fifth transistor being connected to the junction point of the first and second transistors.

According to an embodiment, the current mirror imposes in the second branch a current proportional to the bias current.

According to an embodiment, the junction point of the fourth and fifth transistors forms a node for supplying the output voltage of the second circuit.

According to an embodiment, the fourth and fifth transistors are NMOS transistors, the drain of the fourth transistor being connected to the source of the fifth transistor, and the drain of the fifth transistor being connected to the gates of the fourth and fifth transistors.

According to an embodiment, the fourth and fifth transistors are both of RVT type or both of LVT type.

According to an embodiment, the first circuit comprises sixth and seventh transistors assembled as a current mirror and an eighth transistor series-connected with the seventh transistor, the sixth and seventh transistors being of same LVT or RVT type and having the same front surface gate oxide thickness, and the sixth transistor having a channel-width-to-channel-length ratio greater than that of the seventh transistor.

According to an embodiment, the eighth transistor is of LVT type.

According to an embodiment, the sixth, seventh, and eighth transistors are of NMOS type.

According to an embodiment, the eighth transistor has its front surface gate coupled to the reference voltage supply node.

The foregoing and other features and advantages will be discussed in detail in the following non-limiting description of specific embodiments in connection with the accompanying drawings.

DETAILED DESCRIPTION

Figure 1:
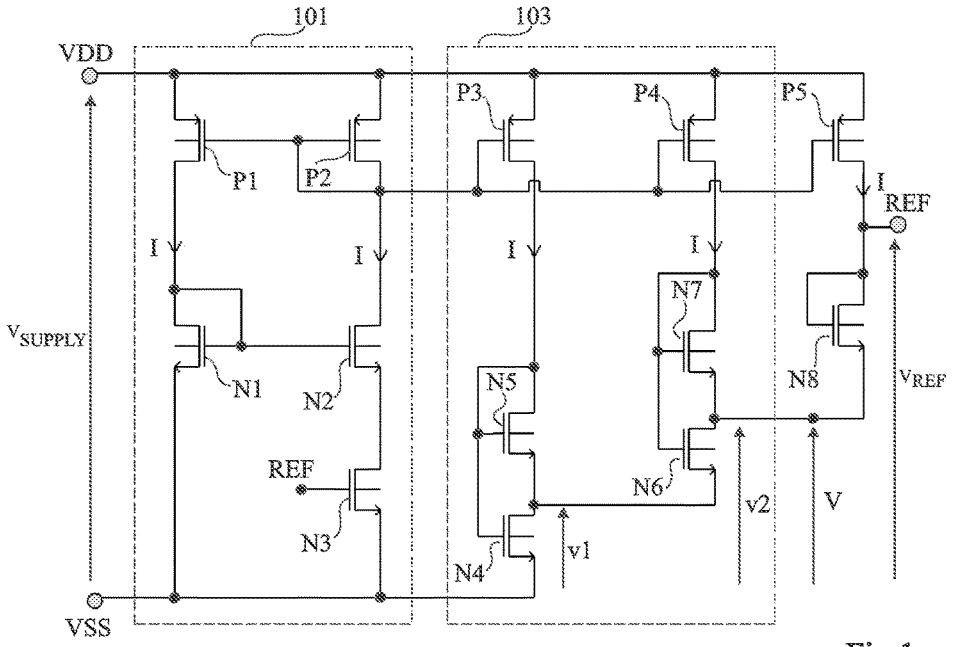
FIG. 1 is an electric diagram of an embodiment of a reference voltage generation circuit.

The same elements have been designated with the same reference numerals in the different drawings. For clarity, only those elements which are useful to the understanding of the described embodiments have been shown and detailed. In particular, the uses which may be made of the described reference voltage generation circuits are not detailed, the described embodiments being compatible with usual applications of a reference voltage generation circuit. Unless otherwise specified, expressions "approximately", "about", "substantially", and "in the order of" mean to within 10%, preferably to within 5%. In the present description, term "connected" is used to designate a direct electric connection, with no intermediate electronic component, for example, by means of one or a plurality of conductive tracks, and term "coupled" or term "linked" is used to designate either a direct electric connection (then meaning "connected") or a connection via one or a plurality of intermediate components (resistor, diode, capacitor, etc.).

FIG. 1 is an electric diagram of an embodiment of a reference voltage generation circuit.

The circuit of FIG. 1 is formed from MOS transistors in FDSOI ("Fully Depleted Semiconductor On Insulator") technology. More particularly, the MOS transistors of the circuit of FIG. 1 are formed inside and on top of a structure of semiconductor-on-insulator type comprising a stack of a semiconductor substrate coated with a layer of a dielectric material, the layer being itself coated with a semiconductor layer. Each transistor comprises an insulated conductive gate, called front surface gate, coating the surface of the semiconductor layer opposite to the dielectric layer. The channel-forming region of the transistor is located under the front surface gate, in the semiconductor layer. The source and drain regions of the transistor are for example implanted regions formed in the semiconductor layer, on either side of the channel-forming region. The source and drain regions are respectively P-type doped for a P-channel transistor (PMOS) and N-type doped for an N-channel transistor (NMOS). The substrate region located under the dielectric layer, opposite the channel-forming region of the transistor, is called rear surface gate, and may be biased to control the threshold voltage of the transistor.

A manufacturing process in FDSOI technology is here considered, where, for each conductivity type (NMOS and PMOS), two types of transistors, respectively called RVT ("Regular Voltage Threshold") and LVT ("Low Voltage Threshold") having, for identical front surface gate dimensions and for identical rear surface gate bias voltages, different threshold voltages, are available. More particularly, for identical front surface gate dimensions and identical rear surface gate bias voltages, RVT transistors have a greater threshold voltage than LVT transistors. In this example, to obtain transistors having different threshold voltages, the doping of the substrate region located in contact with the dielectric layer, opposite the channel-forming region of the transistor (corresponding to the rear surface gate of the transistor), is varied. More particularly, LVT transistors comprise a well of same conductivity type as the source and drain regions of the transistor, extending in the substrate, under the dielectric layer, opposite the channel-forming region of the transistor, and RVT transistors comprise a well of a conductivity type opposite to that of the source and drain regions, extending in the substrate, under the dielectric layer, opposite the channel-forming region of the transistor. As a variation, the LVT or RVT behavior of the transistors may be obtained by varying a parameter other than the doping of the substrate region located under the channel-forming region of the transistor, for example, by varying the doping of the front surface gate of the transistor.

Further, in this example, a manufacturing process in FDSOI technology where each of the fourth above-mentioned transistor types, that is, the NMOS LVT type, the NMOS RVT type, the PMOS LVT type, and the PMOS RVT type, may be obtained in two sub-types, respectively called SO and DO, corresponding to different front surface gate insulator or oxide thicknesses. More particularly, transistors of SO (simple oxide) type have a first front surface gate oxide thickness, and transistors of DO (double oxide) type have a second front surface gate oxide thickness greater than the first thickness, for example, twice greater than the first thickness.

The circuit of FIG. 1 comprises terminals or nodes VDD and VSS of application of a power supply voltage VSUPPLY, and a terminal or a node REF for supplying a reference voltage VREF. In the shown example, node VDD is intended to receive the high potential of power supply voltage VSUPPLY, and node VSS is intended to receive the low potential of power supply voltage VSUPPLY. Reference voltage VREF supplied on node REF is referenced to node VSS, which for example corresponds to the circuit ground.

The circuit of FIG. 1 comprises a circuit 101 for generating a bias current I of CTAT ("Complementary To Absolute Temperature") type, that is, having an intensity which decreases as the temperature increases. In the shown example, current I is generated from a gate-source voltage difference between two transistors N1 and N2 of the same type having different dimensions. Such a gate-source voltage difference is applied across a transistor N3 operating in linear state to generate current I. In this example, transistors N1, N2, and N3 are NMOS transistors. Transistors N1 and N2 are for example both LVT transistors. As a variation, transistors N1 and N2 are both RVT transistors. Transistors N1 and N2 are for example both double oxide (DO) transistors. Transistor N3 is for example an NMOS double oxide (DO) LVT transistor. Ratio $KN_1$ of channel width $W_{N1}$ to channel length $L_{N1}$ of transistor N1 is different from ratio $K_{N2}$ of channel width $W_{N2}$ to channel length $L_{N2}$ of transistor N2. As an example, ratio $K_{N1}$ is smaller than ratio $K_{N2}$ so that, in operation, the gate-source voltage of transistor N1 is greater than the gate-source voltage of transistor N2. Transistors N1 and N2 are current-mirror assembled. More particularly, transistor N1 has its front surface gate connected to its drain and has its source coupled to node VSS. The front surface gate of transistor N2 is connected to the front surface gate of transistor N1. The source of transistor N2 is coupled to node VSS via transistor N3. More particularly, the drain of transistor N3 is connected to the source of transistor N2, and the source of transistor N3 is coupled to node VSS. In this example, the front surface gate of transistor N3 is connected to output node REF of the circuit.

In addition to transistors N1, N2 and N3, circuit 101 for generating bias current I comprises a PMOS transistor P1 coupling the drain of transistor N1 to node VDD, and a PMOS transistor P2 coupling the drain of transistor N2 to node VDD. Transistor P1 has its drain connected to the drain of transistor N1 and transistor P2 has its drain connected to the drain of transistor N2. Transistor P1 has its source coupled to node VDD and transistor P2 has its source coupled to node VDD. Transistors P1 and P2 are current-mirror assembled. More particularly, transistor P1 has its front surface gate connected to the front surface gate of transistor P2, and transistor P2 has its front surface gate connected to its drain. Transistors P1 and P2 are for example both RVT transistors. As a variation, transistors P1 and P2 are both LVT transistors. Transistors P1 and P2 are for example both double oxide (DO) transistors.

The circuit of FIG. 1 further comprises a circuit 103 for generating a voltage V of PTAT ("Proportional To Absolute Temperature") type, that is, having a value which increases as the temperature increases.

In this example, circuit 103 comprises a first branch comprising a transistor N4 series-connected with a transistor N5, and a second branch comprising a transistor N6 series-connected with a transistor N7. In this example, transistors N4, N5, N6, and N7 are of NMOS type.

Transistors N4 and N5 are for example respectively of simple oxide (SO) LVT type and of double oxide (DO) LVT type. As a variation, transistors N4 and N5 of the first branch are respectively of simple oxide (SO) LVT type and of double oxide (DO) RVT type. As a variation, transistors N4 and N5 of the first branch are respectively of simple oxide (SO) RVT type and of double oxide (DO) LVT type. More generally, the first branch is a so-called mixed oxide thickness branch (that is, its transistor located on the side of node VSS, that is, its transistor N4, is a simple-oxide transistor, and its transistor opposite node VSS, that is, its transistor N5, is a double-oxide transistor), having at least two transistors N4 and N5 of LVT type.

Transistors N6 and N7 are for example both RVT transistors. As a variation, transistors N6 and N7 are both LVT transistors. Transistors N5 and N6 are double-oxide transistors (DO). Thus, in this example, the second branch is a so-called double-oxide branch (that is, its two transistors N6 and N7 are double-oxide transistors), having its two transistors N6 and N7 of the same type, either LVT or RVT.

Transistor N4 has its source coupled to node VSS and its drain connected to the source of transistor N5. Transistor N5 has its drain connected to its front surface gate. The front surface gate of transistor N5 is further connected to the front surface gate of transistor N4. Transistor N6 has its source connected to the junction point of transistors N4 and N5, that is, to the source of transistor N5 and to the drain of transistor N4. Transistor N6 has its drain connected to the source of transistor N7. Transistor N7 has its drain connected to its front surface gate. The front surface gate of transistor N7 is further connected to the front surface gate of transistor N6. The junction point of transistors N6 and N7, that is, the source node of transistor N7 or drain node of transistor N6, forms the node for supplying output voltage V of circuit 103 (referenced to node VSS).

In this example, circuit 103 further comprises a PMOS transistor P3 coupling the drain of transistor N5 to node VDD, and a PMOS transistor P4 coupling the drain of transistor N7 to node VDD. Transistor P3 has its drain connected to the drain of transistor N5, and transistor P4 has its drain connected to the drain of transistor N7. Transistors P3 and P4 each have their source coupled to node VDD. Each of transistors P3 and P4 is assembled to form a current mirror with transistor P2. More particularly, transistor P3 has its front surface gate connected to the front surface gate of transistor P2, and transistor P4 has its front surface gate connected to the front surface gate of transistor P2. Transistors P3 and P4 are for example both RVT transistors. As a variation, transistors P3 and P4 are both LVT transistors. Transistors P3 and P4 are for example both double-oxide (DO) transistors.

The circuit of FIG. 1 further comprises a diode-assembled transistor N8, where CTAT-type bias current I is applied, and having a conduction node receiving PTAT-type output voltage V of circuit 103. In this example, transistor N8 is an NMOS transistor. Transistor N8 for example is an RVT transistor, for example, a double-oxide transistor (DO). The source of transistor N8 is connected to the node for supplying output voltage V of circuit 103, that is, to the source node of transistor N7 and to the drain node of transistor N6 in this example. The drain of transistor N8 is connected to its front surface gate and to output node REF of the circuit of FIG. 1. In this example, the circuit of FIG. 1 further comprises a PMOS transistor P5 coupling the drain of transistor N8 to node VDD. Transistor P5 has its drain connected to the drain of transistor N8 and its source coupled to node VDD. Transistor P5 is assembled to form a current mirror with transistor P2. More particularly, transistor P5 has its front surface gate connected to the front surface gate of transistor P2. Transistor P5 may be of RVT type or of LVT type. As an example, transistor P5 is a double-oxide transistor (DO). Transistors P1, P2, P3, P4 and P5 are for example identical, that is, of the same type (RVT or LVT, of same oxide thickness DO or SO) and substantially have the same dimensions.

In operation, a same bias current I flows through the branch comprising transistors P1 and N1, and through the branch comprising transistors P2, N2, and N3. Transistor N3, operating in linear state, sees between its terminals a PTAT voltage equal to the difference between the gate-source voltage of transistor N1 and the gate-source voltage of transistor N2, which sets the value of current I. The internal resistance of transistor N3 increases with temperature faster than the PTAT voltage seen by transistor N3, so that current I (which is the ratio of the voltage across transistor N3 to the internal resistance of transistor N3) decreases with temperature.

Bias current I generated by circuit 101 is copied in the branch comprising transistors P3, N5, and N4, and in the branch comprising transistors P4, N7, and N6. Under the effect of this current a PTAT-type voltage v1 is supplied onto the junction point of transistors N4 and N5, and a voltage v2, also of PTAT type but having a level greater than v1, is supplied onto the junction point of transistors N6 and N7. Voltages v1 and v2 are referenced to node VSS. In this example, output voltage V of circuit 103 is voltage v2.

The bias current I generated by circuit 101 is further copied in the branch comprising transistors P5 and N8. Output voltage $V_{REF}$ of the circuit of FIG. 1 is equal to the sum of the gate-source voltage of transistor N8 and of output voltage V of circuit 103. When the temperature increases, current I tends to decrease, and the threshold voltage of transistor N8 tends to decrease, which would tend to lower voltage $V_{REF}$. However, output voltage V of circuit 103 increases with temperature, which enables to maintain a relative temperature stability for voltage $V_{REF}$.

Power supply voltage $V_{SUPPLY}$ and the dimensions of the transistors of the circuit of FIG. 1 are preferably selected so that, in operation, transistors P1, P2, P3, P4, P5, N4, N5, and N8 are in saturation state, transistors N1, N2, N6, and N7 are in subthreshold conduction state, and transistor N3 is in linear state.

As an example, power supply voltage $V_{SUPPLY}$ is in the order of 1.2 V, and the dimensions of transistors N1, N2, N3, N4, N5, N6, N7, and N8 are substantially as follows:

$KN1=WN1/LN1=2\ \mu m/15\ \mu m;$ $KN2=WN2/LN2=6\ \mu m/15\ \mu m;$ $KN3=WN3/LN3=0.17\ \mu m/(2*30\ \mu m);$ $KN4=WN4/LN4=0.34\ \mu m/30\ \mu m;$ $KN5=WN5/LN5=0.68\ \mu m/30\ \mu m;$ $KN6=WN6/LN6=0.34\ \mu m/4\ \mu m;$ $KN7=WN7/LN7=12.24\ \mu m/4\ \mu m;$ and $KN8=WN8/LN8=0.34\ \mu m/30\ \mu m,$ where $W_{Ni}$, $L_{Ni}$ and $K_{Ni}$ respectively designate the channel width of transistor Ni, the channel length of transistor Ni, and the channel-width-to-channel-length ratio of transistor Ni, i being an integer in the range from 1 to 8. As an example, transistors of the SO (simple oxide) type are capable of withstanding with no degradation a maximum voltage in the order of 1 V, and DO-type transistors are capable of withstanding with no degradation a maximum voltage in the order of 1.8 V.

As an example, all the NMOS transistors of the circuit of FIG. 1 have their rear surface gates coupled to ground, that is, to node VSS, and all the PMOS transistors of the circuit have their rear surface gates coupled to node VDD of application of the high power supply potential of the circuit. The described embodiments are however not limited to this specific case. As a variation, all the transistors of the circuit of FIG. 1 may have, in operation, their rear surface gates biased to a same reference potential different from the potential of node VSS or VDD. As a variation, different transistors of the circuit of FIG. 1 may have, in operation, their rear surface gates biased to different potentials.

Figure 2:
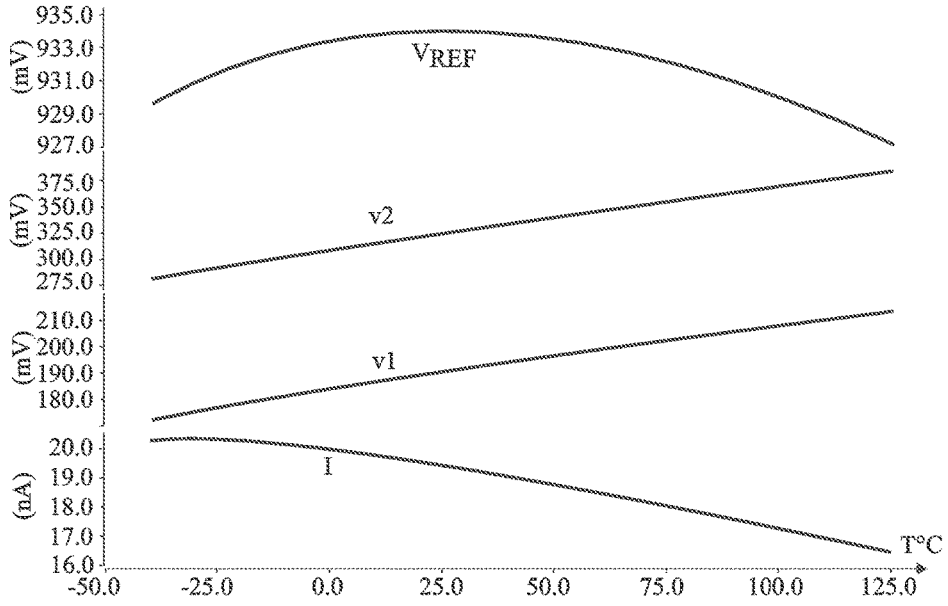
FIG. 2 is a diagram illustrating the operation of the circuit of FIG. 1.

FIG. 2 is a diagram illustrating the behavior of the circuit of FIG. 1. More particularly, FIG. 2 shows the variation according to temperature, within a temperature range from −40° C. to +125° C., of bias current I, in nanoamperes, of voltages v1 and v2, in mV, and of output voltage $V_{REF}$, in mV of the circuit of FIG. 1. As shown in FIG. 2, current I substantially linearly decreases according to temperature from a high value in the order of 20.2 nA for a −40° C. temperature to a low value in the order of 16.5 nA for a 125° C. temperature, voltage v1 substantially linearly increases according to temperature from a low value in the order of 172 mV for a −40° C. temperature to a high value in the order of 215 mV for a 125° C. temperature, and voltage v2 substantially linearly increases according to temperature from a low value in the order of 280 mV for a −40° C. temperature to a high value in the order of 385 mV for a 125° C. temperature. Reference voltage VREF follows a bell shape between 928 mV and 934 mV within the temperature range from −40° C. to +125° C.

Figure 3:
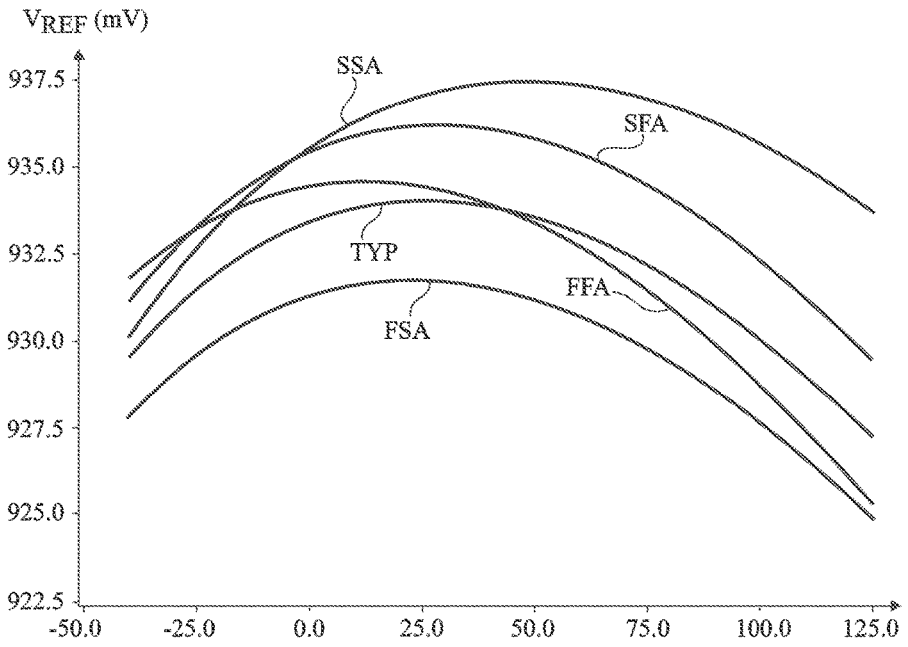
FIG. 3 is a diagram showing the sensitivity of the circuit of FIG. 1 to manufacturing process variations.

The tests which have been performed have shown that the circuit of FIG. 1 has a very good intrinsic accuracy as compared with existing circuits (that is, the output voltage being almost independent from process variations), as illustrated, in particular, in FIG. 3.

FIG. 3 shows the variation of output voltage VREF of the circuit of FIG. 1 according to temperature, within the temperature range from −40° C. to +125° C., at the different limits of the variations of parameters of the manufacturing process, in the considered FDSOI manufacturing technology (here, the 28-nm FDSOI technology). More particularly, FIG. 3 comprises a curve FSA corresponding to the case where the NMOS transistors are faster than usual and where the PMOS transistors are slower than usual, a curve FFA corresponding to the case where the NMOS and PMOS transistors are faster than usual, a curve SFA corresponding to the case where the NMOS transistors are slower than usual and the PMOS transistors are faster than usual, a curve SSA corresponding to the case where the NMOS and PMOS transistors are slower than usual, and a curve TYP corresponding to the case where the NMOS and PMOS transistors have an average speed.

As shown in FIG. 3, the inaccuracy of the circuit of FIG. 1 due to manufacturing dispersions is in the order of 5.5 mV at 25° C. for a typical reference voltage in the order of 934 mV, which corresponds to a 0.5% peak-to-peak inaccuracy. The measurements which have been performed show that at a given temperature, the ratio of the standard deviation of the distribution of the reference voltages supplied by the circuits of a batch representative of the manufacturing process variations to the average reference voltage of the distribution is in the order of +/−0.1%.

The inventors have determined that the good intrinsic accuracy of the circuit of FIG. 1, that is, the fact for the reference voltage delivered by the circuit to be relatively little dependent on process variations, mainly results from the combination of a circuit 103 for generating a PTAT-type voltage V having a first branch (transistors N4 and N5) of mixed oxide thickness and comprising at least one LVT-type transistor (N4 or N5), and a double oxide RVT-type transistor N8 to form the output stage of the circuit for generating reference voltage VREF. The selection of an LVT-type transistor N3 in the second branch of circuit 101 for generating bias current I also contributes to increasing the intrinsic accuracy of the circuit.

In addition to its good intrinsic accuracy, an advantage of the circuit of FIG. 1 is that the level of the supplied reference voltage can be easily adjusted on design by varying bias current I and the channel-width-to-channel-length ratio of the different transistors. In particular, the reference voltage supplied by the circuit of FIG. 1 may, if need be, be set to a level close to power supply voltage VSUPPLY. Indeed, the minimum interval between power supply voltage VSUPPLY and output voltage VREF corresponds to the minimum drain-source voltage necessary to obtain a good copying of bias current I by transistor P5, which may be in the order of 200 mV.

Further, since the circuit of FIG. 1 only comprises MOS transistors, it requires but a small silicon surface area to be formed, and has a relatively low electric power consumption. As concerns the occupied surface area, a compromise can be chosen between the intrinsic accuracy and the silicon surface area according to the needs of the application. Indeed, the larger the surface areas W*L of the MOS transistors of the circuit, the better the intrinsic accuracy of the circuit. As concerns the power consumption, an advantage of the circuit of FIG. 1 is that, due to the fact that bias current I is of CTAT type, the circuit power consumption does not increase when the temperature increases.

Specific embodiments have been described. Various alterations, modifications, and improvements will occur to those skilled in the art. In particular, the described embodiments are not limited to the example of circuit 101 for generating a bias current I described in relation with FIG. 1. More generally, circuit 101 may be replaced with any other circuit capable of generating a CTAT-type bias current I.

As a variation, circuit 101 may be replaced with a circuit capable of generating a PTAT-type bias current I. In this case, the sizing of the transistors, and in particular the sizing of transistor N8, may be adjusted to preserve a good temperature stability of the output voltage. It should however be noted that the use of a circuit 101 capable of generating a CTAT-type bias current I is preferable since it enables to limit the general electric power consumption of the circuit.

Further, the described embodiments are not limited to the example of circuit 103 for generating a PTAT-type voltage V described in relation with FIG. 1.

As a variation, it may in particular be provided to suppress the branch comprising transistors P4, N7 and N6, and to couple the source of transistor N8 directly to the junction point of transistors N4 and N5. In this case, the voltage V applied to the source of transistor N8 is voltage v1.

In another variation, it may be provided to replace the second branch (transistors N6 and N7) with a branch of mixed oxide thickness comprising at least one LVT transistor. In other words, the transistor N6 located on the side of node VSS may be replaced with a simple oxide transistor, transistor N7 remaining a double oxide transistor, and at least one of the two transistors N6 and N7 being an LVT-type transistor, while the other transistor may be of LVT or RVT type.

Figure 4:
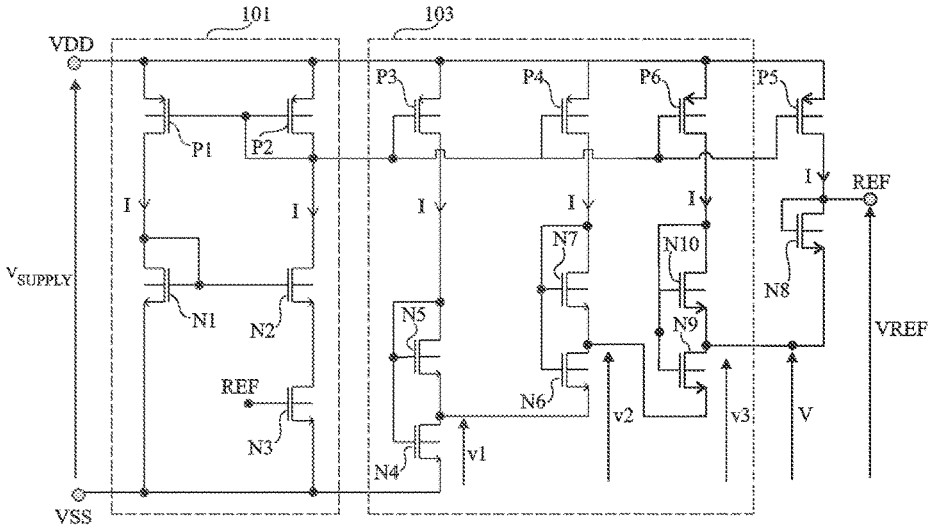
FIG. 4 is an electric diagram of an alternative embodiment of the circuit of FIG. 1.

In another variation illustrated in FIG. 4, each of the first (transistors N4 and N5) and second (transistors N6 and N7) branches of circuit 103 is a branch of mixed oxide thickness comprising at least one LVT-type transistor (such as described in the previous paragraph), and circuit 103 further comprises a third branch comprising a transistor N9 series-connected with a transistor N10. In this example, transistors N9 and N10 are of NMOS type. The third branch is a double oxide branch, that is, its two transistors N9 and N10 are double oxide transistors (DO). Transistors N9 and N10 are for example both RVT transistors or both LVT transistors.

Transistor N9 has its source connected to the junction point of transistors N6 and N7, that is, to the source of transistor N7 and to the drain of transistor N6. Transistor N9 has its drain connected to the source of transistor N10. Transistor N10 has its drain connected to its front surface gate. The front surface gate of transistor N10 is further connected to the front surface gate of transistor N9. The junction point of transistors N9 and N10, that is, the source node of transistor N10 and drain node of transistor N9, forms the node for supplying output voltage V of circuit 103 (referenced to node VSS).

In this example, circuit 103 further comprises a PMOS transistor P6 coupling the drain of transistor N10 to node VDD. Transistor P6 has its drain connected to the drain of transistor N10, and its source coupled to node VDD. Transistor P6 is assembled to form a current mirror with transistor P2. More particularly, transistor P6 has its front surface gate connected to the front surface gate of transistor P2. Transistor P6 is for example of RVT type. As a variation, transistor P6 is of LVT type. Transistor P6 for example is a double oxide (DO) transistor. Transistor P6 is for example identical to transistors P1, P2, P3, P4 and P5.

In the variation of FIG. 4, diode-assembled transistor N8 has its source connected, no longer to the midpoint of the second branch, that is, to the source node of transistor N7 and drain node of transistor N6, but to the midpoint of the third branch, that is, to the source node of transistor N10 and drain node of transistor N9.

In operation, the bias current I generated by circuit 101 is copied in the branch comprising transistors P3, N5, and N4, in the branch comprising transistors P4, N7, and N6, and in the branch comprising transistors P6, N10, and N9. Under the effect of this current, a PTAT-type voltage v1 is supplied onto the junction point of transistors N4 and N5, a voltage v2, also of PTAT type but having a level greater than v1, is supplied onto the junction point of transistors N6 and N7, and a voltage v3 also of PTAT type but having a level greater than v2 is supplied onto the junction point of transistors N9 and N10. In this example, output voltage V of circuit 103 is voltage v3.

Thus, the operation of the circuit of FIG. 4 is similar to that of the circuit of FIG. 1, but for the fact that output voltage V of circuit 103 is greater than in the example of FIG. 1.

An advantage of the circuit of FIG. 4 is that it has an intrinsic accuracy which is even better than that of the circuit of FIG. 1, that is, a dependence of its output voltage VREF to process variations which is lower than in the example of FIG. 1, especially due to the increase in the value of output voltage V of circuit 103.

The described embodiments are not limited to the above examples where transistors N1, N2, N3, N4, N5, N6, N7, N8, and, possibly (FIG. 4), N9 and N10 are N-channel MOS transistors. As a variation, a similar (complementary) circuit can be obtained by inverting the conductivity types of all transistors.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for generating a reference voltage formed in Fully Depleted Silicon On Insulator technology, comprising:

a first circuit for generating a bias current;

a second circuit for generating a Proportional To Absolute Temperature-type voltage comprising a first branch comprising a first transistor and a second transistor, the first and second transistors being connected in series with each other, front surface gates of the first and second transistors being connected to a conduction node of the second transistor opposite to the first transistor;

a third diode-assembled transistor having a conduction node connected to a node for supplying an output voltage of the second circuit, the third diode-assembled transistor having another conduction node forming a node for supplying the reference voltage; and a current mirror imposing, in the third transistor and in the first branch, currents proportional to the bias current, wherein at least one of the first and second transistors is of Low Voltage Threshold type, and the third transistor is of Regular Voltage Threshold type, and wherein the first transistor has a first front surface gate insulator thickness, the second transistor and the third transistor having a second front surface gate insulator thickness greater than the first thickness.

2. The circuit of claim 1, wherein a drain of the first transistor is connected to a source of the second transistor, the drain of the second transistor being connected to gates of the first and second transistors.

3. The circuit of claim 1, wherein a source of the third transistor is connected to a node for supplying the output voltage of the second circuit.

4. The circuit of claim 1, wherein:

the second circuit further comprises a second branch comprising fourth and fifth series-connected transistors, front surface gates of the fourth and fifth transistors being connected to a conduction node of the fifth transistor opposite to the fourth transistor, and a conduction node of the fourth transistor opposite to the fifth transistor being connected to a junction point of the first and second transistors; and the current mirror imposes in the second branch a current proportional to the bias current.

5. The circuit of claim 4, wherein a drain of the fourth transistor is connected to a source of the fifth transistor, and a drain of the fifth transistor is connected to gates of the fourth and fifth transistors.

6. The circuit of claim 4, wherein the fourth and fifth transistors both have a gate insulator thickness equal to the second thickness, and are both of Regular Voltage Threshold type or both of Low Voltage Threshold type.

7. The circuit of claim 4, wherein the fourth transistor has a gate insulator thickness equal to the first thickness, the fifth transistor having a gate insulator thickness equal to the second thickness, and wherein at least one of the fourth and fifth transistors is of Low Voltage Threshold type.

8. The circuit of claim 7, wherein:

the second circuit further comprises a third branch comprising sixth and seventh series-connected transistors, front surface gates of the sixth and seventh transistors being connected to a conduction node of the seventh transistor opposite to the sixth transistor, and a conduction node of the sixth transistor opposite to the seventh transistor being connected to a junction point of the fourth and fifth transistors; and the current mirror imposes in the third branch a current proportional to the bias current.

9. The circuit of claim 8, wherein a drain of the sixth transistor is connected to a source of the seventh transistor, and a drain of the seventh transistor is connected to gates of the sixth and seventh transistors.

10. The circuit of claim 8, wherein the sixth and seventh transistors both have a gate insulator thickness equal to the second thickness, and are both of Regular Voltage Threshold type or both of Low Voltage Threshold type.

11. The circuit of claim 1, wherein the first circuit comprises eighth and ninth transistors assembled as a current mirror, and a tenth transistor series-connected with the ninth transistor, the eighth and ninth transistors being of same Low Voltage Threshold or Regular Voltage Threshold type and having a same front surface gate oxide thickness, and the eighth transistor having a channel-width-to-channel-length ratio greater than a channel-width-to-channel-length ratio of the ninth transistor.

12. The circuit of claim 11, wherein the tenth transistor is of Low Voltage Threshold type.

13. The circuit of claim 11, wherein the eighth, ninth, and tenth transistors are of NMOS type.

14. The circuit of claim 11, wherein the tenth transistor has a front surface gate coupled to the node for supplying the reference voltage.

15. The circuit of claim 1, wherein the first circuit is adapted to generate a Complementary To Absolute Temperature-type bias current.

* * * * *